US005341743A

United States Patent [19]

Redaud

[11] Patent Number: 5,341,743

[45] Date of Patent: Aug. 30, 1994

[54] DIRECTED-EFFECT MUNITION

[75] Inventor: Christophe Redaud, Bourges, France

[73] Assignee: Giat Industries, Versailles, France

[21] Appl. No.: 124,012

[22] Filed: Sep. 21, 1993

[30] Foreign Application Priority Data

Sep. 21, 1992 [FR] France ..... 92 11220

[51] Int. Cl.[5] ..... F41G 9/00; F41G 7/24

[52] U.S. Cl. ..... 102/384; 102/393; 102/401; 102/476

[58] Field of Search ..... 102/384, 386, 387, 385, 102/393, 401, 476

[56] References Cited

U.S. PATENT DOCUMENTS

| | | | |
|---|---|---|---|
| 4,568,040 | 2/1986 | Metz | 102/384 |
| 4,674,408 | 6/1987 | Stessen | 102/384 |
| 4,711,178 | 12/1987 | Argyrakis | 102/387 |
| 4,858,532 | 8/1989 | Persson et al. | 102/387 |
| 4,878,433 | 11/1989 | Pirolli | 102/384 |
| 5,076,511 | 12/1991 | Stein et al. | 102/384 |
| 5,138,947 | 8/1992 | Opitz et al. | 102/384 |
| 5,142,986 | 9/1992 | Gundel | 102/401 |
| 5,169,093 | 12/1992 | Schöffl | 102/387 |

FOREIGN PATENT DOCUMENTS

| | | | |
|---|---|---|---|
| 0033283 | 8/1981 | European Pat. Off. . | |
| 0252036 | 1/1988 | European Pat. Off. . | |
| 0306391 | 3/1989 | European Pat. Off. . | |
| WO9012997 | 11/1990 | PCT Int'l Appl. | 102/401 |
| 2224173A | 4/1990 | United Kingdom . | |

*Primary Examiner*—David H. Brown
*Attorney, Agent, or Firm*—Oliff & Berridge

[57] ABSTRACT

A directed-effect submunition moves in a substantially vertical direction V with a displacement velocity v parallel to V and a rotation velocity r about an axis parallel to V. The submunition includes a shaped charge with axis D forming an acute angle t with axis V and a detection device with axis d forming an angle u with axis D, a target detecting device, and a triggering device. The submunition also includes a displacement velocity v determining device, and a calculation device for calculating as a function of v a value $u_i$ for angle u that minimizes deviation (e) between the position (M) of a target detected, and impact point (M') of the penetrator of the shaped charge if the latter were triggered upon detection, as well as a device for imparting the value $u_i$ to angle u.

13 Claims, 5 Drawing Sheets

DIRECTED-EFFECT MUNITION

BACKGROUND OF THE INVENTION

This invention concerns a directed-effect munition designed to be launched, by means of a vector, above an area containing a target, wherein the munition includes a warhead having a shaped charge and a detection device that actuates a detonation device.

The invention concerns in particular a submunition designed to be expelled by a mine or a vector, the submunition being in turn launched by an aircraft or an artillery piece, such that the submunition is given a displacement velocity v along a substantially vertical axis V, and a rotation velocity r substantially about the same axis.

A weapon system of this kind is described U.S. Pat. No. 4,858,532 to Persson et al. The axis of the detection device is tilted approximately 30° with respect to the rotation axis of the submunition so that during its descending movement, the surface region covered by the detector device at a given moment moves in spiral fashion over the detection area, thus increasing the probability that the target will be detected.

When the target is detected, a signal triggers the shaped charge, which acts vertically downward while the submunition is in a substantially vertical descending portion of its trajectory. It is evident that a warhead of this type could just as easily operate in an ascending trajectory, as in the case of the first part of the trajectory of a submunition launched by a land mine.

Such a system has the advantage that targets can be engaged remotely, with no need for guidance, and with the use of a simple detection scheme.

However, this structure has considerable drawbacks resulting firstly from inaccurate detection, since the appearance of a detection signal means only that at least a part of the target is within the detection zone, and resulting secondly from well-known error sources associated with the velocity components v and r of the submunition.

To clarify the drawbacks of the prior method, the implementation principles of the method will be described below with reference to FIGS. 1 to 5 of the attached drawings.

FIGS. 1 to 5, which refer to a conventional submunition, illustrate a submunition 1 including a shaped charge 2 that moves with a displacement velocity v along a substantially vertical axis V, and with a rotation velocity r about an axis substantially identical to V, in the vicinity of a plane 3 containing a target 5, such as a land vehicle.

Shaped charge 2 has rotational symmetry about an axis D that forms an angle t with axis V. A detector 7, with a detection axis d substantially parallel to axis D, can act on an igniter 8 placed behind shaped charge 2. Detection axis d rotates about axis V, scanning a surface area whose intersection with plane 3 containing target 5 forms a spiral 9. Detection is effective within a solid angle with axis d, impinging on plane 3 over a surface area 4. FIG. 1 shows a spiral 10, which to some extent encompasses spiral 9 and corresponds to the envelope in plane 3 of the outline of instantaneous detection surface area 4.

FIG. 3 diagrams the impact point deviation resulting solely from rotation of the charge. The plane of FIG. 3 is parallel to the target plane, which is assumed to be horizontal. Circle C with center 0 is the location of the detected points (intersection between detection axis d and the ground), and circle C′ is the location of the impact points on the ground. The target, located at point M, is detected at time $t_0$ and firing is triggered at time $t_1$ ($t_1-t_0=a$, corresponding to the calculation time).

If r is the rotational velocity of the charge, and n is the distance between the center of gravity of the casing of the explosively formed penetrator, and rotation axis V, angle s1 is equal to r.a, and is induced by rotation of the charge during the calculation time. It causes point M to correspond to a point M″ on circle C.

Angle s2 is equal to arctan ($n.r/V_{pen}.\sin t$), $V_{pen}$ being the velocity (assumed to be constant) of the penetrator after firing. This angle is induced by the velocity n.r impressed by the charge on the penetrator velocity. It causes point M″ to correspond to a point M′ on circle C′. The total error is equal to MM′.

The angular error resulting from s=s1+s2 is constant over time, and always acts in the same direction. Thus, the impact point is always ahead of the detected point in the direction of rotation. It is thus possible, with a fixed shift in the detection axis with respect to the axis of the charge, to compensate for this error and reduce the total error to merely the deviation $M_1M'$ ($M_1$being the point on circle C offset from point M by an angle s).

The error $M_1M'$, however, still remains to be corrected.

If angle s is constant, deviation compensation could be implemented by shifting detection axis d forward by an identical amount, but error $M_1M'$ would still need to be compensated for.

With regard to the impact deviation due to the substantially vertical displacement velocity v of the charge, a listing will first be given of the orders of magnitude ordinarily encountered with this type of submunition:

v=50 m/s

Velocity of the penetrator generated by the charge: $V_{efp}$=2000 m/s t=30°

Target distance=100 m

Time from detection to charge triggering: a=0.5 ms

Impact point deviation: 1.4 m.

This error also depends on the direction of movement of the submunition. During ascent, the impact point is displaced toward the outside of the spiral; during descent, the impact point is displaced toward the inside of the spiral.

In FIG. 4, the impact deviation has been diagrammed for the case of an ascending charge trajectory; and axis Z represents the vertical axis and axis R represents the axis of the radial distances of the impact point, designated here by P.

For a time a, point Q symbolizing the position of the charge is displaced a distance a.v and moves to Q1. By systematically shifting the position of the detector, an initial correction can be applied by moving from P to $P_1$, line $Q_1P_1$ being parallel to QP; but an error $P_1P'$ would remain.

However, this kind of correction would be disadvantageous for the descent phase, as shown in FIG. 5, since it would correspondingly increase the deviation PP″.

SUMMARY OF THE INVENTION

A purpose of the present invention is to eliminate the drawbacks of known submunitions and to propose a submunition capable of substantially reducing the firing inaccuracy resulting from the displacement and rotation velocities imparted to the submunition, and to do so by providing a simple, relatively inexpensive, and compact apparatus.

An object of the present invention is to provide a directed-effect submunition projected, before being detonated, along a substantially vertical trajectory above a region containing a target, the submunition having a displacement velocity along axis V and a rotation velocity with respect to the axis. The submunition includes a shaped charge with an axis D forming an acute angle t with axis V; a detection device that has a detection axis d forming an angle u with axis D and detects a target and triggers the shaped charge; for determining the displacement velocity v and/or the altitude H of the submunition with respect to the region containing the target; a device for calculating, as a function of v and/or H, a trajectory angle $u_i$, selected from among a set of trajectory angles u, that minimizes a deviation e existing between the position of a target detected at the moment in question and the impact point of the warhead if the latter were triggered upon detection of the target; and a device for imparting the trajectory angle $u_i$ to the angle between the detection axis d and axis D.

With the device according to the invention, it becomes possible, with simple means, to increase the detection accuracy substantially, since the sources of inaccuracy of known submunitions can be corrected to a large extent by an appropriate arrangement of the detection axes corresponding to the various angles $u_i$.

BRIEF DESCRIPTION OF THE DRAWINGS

Other features and advantages of the invention will be evident from the description that will now be given, on a non-limiting basis, of embodiments of this C) invention, with reference to the attached drawings in which.

DETAILED DESCRIPTION OF PREFERRED EMBODIMENTS

According to one advantageous embodiment of the invention, the calculation device compares the minimum value of the deviation obtained for the angle to a threshold, and inhibits triggering of the warhead in the event a target is detected if the minimum deviation is greater than the threshold.

According to another aspect of the invention, the detection device includes at least two detection units and at least two sensors, associated with a single optical system, defining detection axes with different orientations. The sensors are capable of being activated individually.

According to another aspect of the invention, the various detection units consist of a single sensor with which one optical system of a group of several optical systems can be associated.

According to another aspect of the invention, the detectors are of the infrared or millimeter-wave type.

According to yet another aspect of the invention, applied to a submunition designed to be launched from the ground with a substantially vertical upward motion before descending substantially vertically, the submunition includes two detection units, one having an average orientation for the ascent phase and the other an average orientation for the descent phase. The submunition also includes a device for recognizing the transition between the first and second phase and for activating the appropriate detection unit in each phase.

Figure 1:
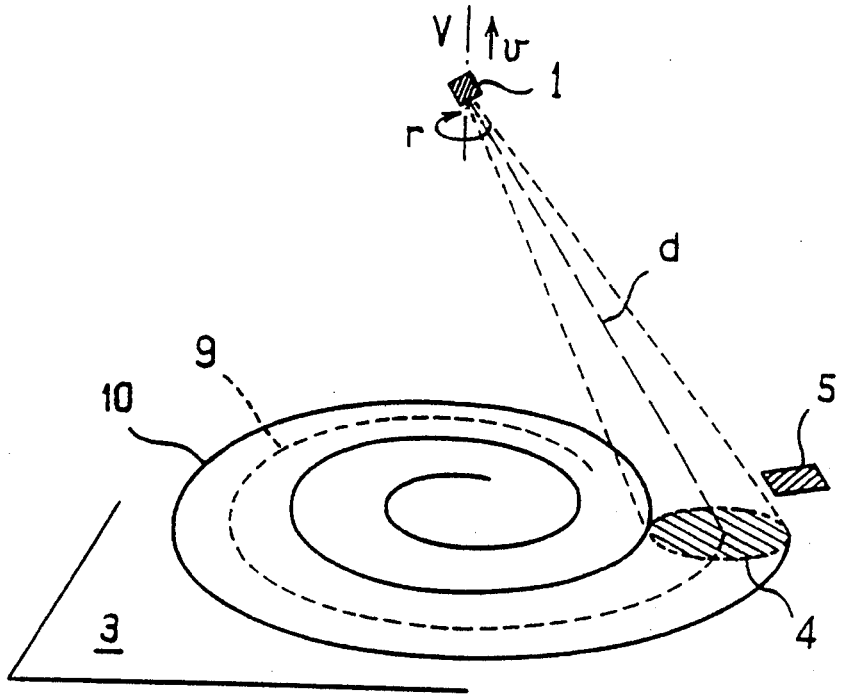
FIG. 1 PRIOR ART
FIG. 1 is an overall schematic perspective view showing a conventional shaped charge munition in the vicinity of the firing area.
Figure 2:
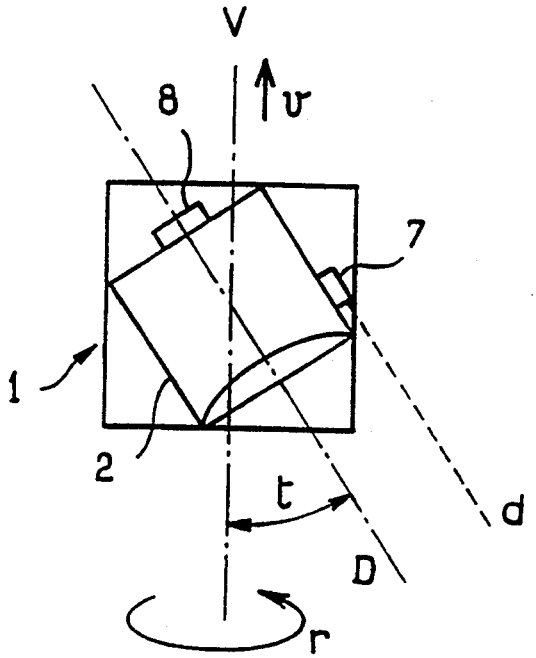
FIG. 2 PRIOR ART
FIG. 2 is a schematic sectional view of a conventional shaped charge submunition equipped with a detector device.

FIGS. 6 to 11 refer to an embodiment of the invention that is applicable to a shaped charge that is analogous to the one in FIG. 2 but to a large extent overcomes the drawbacks outlined above.

The detection device includes a block of four sensors or detectors 21 to 24 arranged radially with respect to axis D of the shaped charge. Associated with these detectors is a single optical system 26 that defines respective detection axes $d_1$ to $d_4$ to which correspond respective angles $u_1$ to $u_4$ with axis d, parallel to axis D of shaped charge 2. In other words, angle $u_i$ can in this case have four values $u_i=u_1, u_2, u_3, u_4$ corresponding respectively to detection axes $d_i=d_1, d_2, d_3, d_4$. Corresponding to detection axes $d_1$ to $d_4$ are respective detection beam tracks 11 to 14 on the target plane (see FIG. 8).

Shown schematically at 28 is a means for obtaining the displacement velocity v, known in the art and consisting in the present case of an accelerometer, an analog/digital converter, and integrators in series. A rangefinder could be used to provide the basic data consisting of the vertical distance to the ground, from which it is easy to derive the value of velocity v as soon as the kinetics of the submunition's trajectory are approximately known.

The submunition's calculation means has also been depicted schematically at 29. Calculation means 29 operates under conditions that will be specified below when the operation of the submunition is described with reference to FIGS. 9 to 11.

Figure 6:
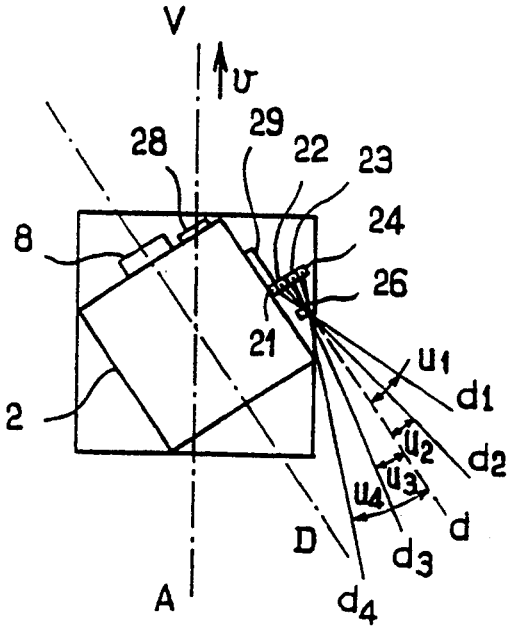
FIGS. 6 and 7 schematically depict two embodiments of the invention in which the detection device includes, respectively, one block of four sensors and two symmetrical blocks with two sensors each.
Figure 7:
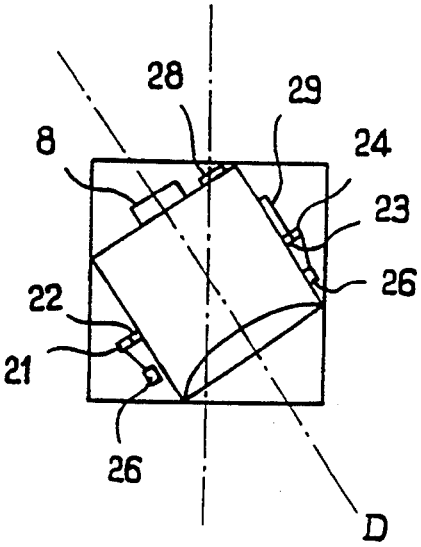
Figure 8:
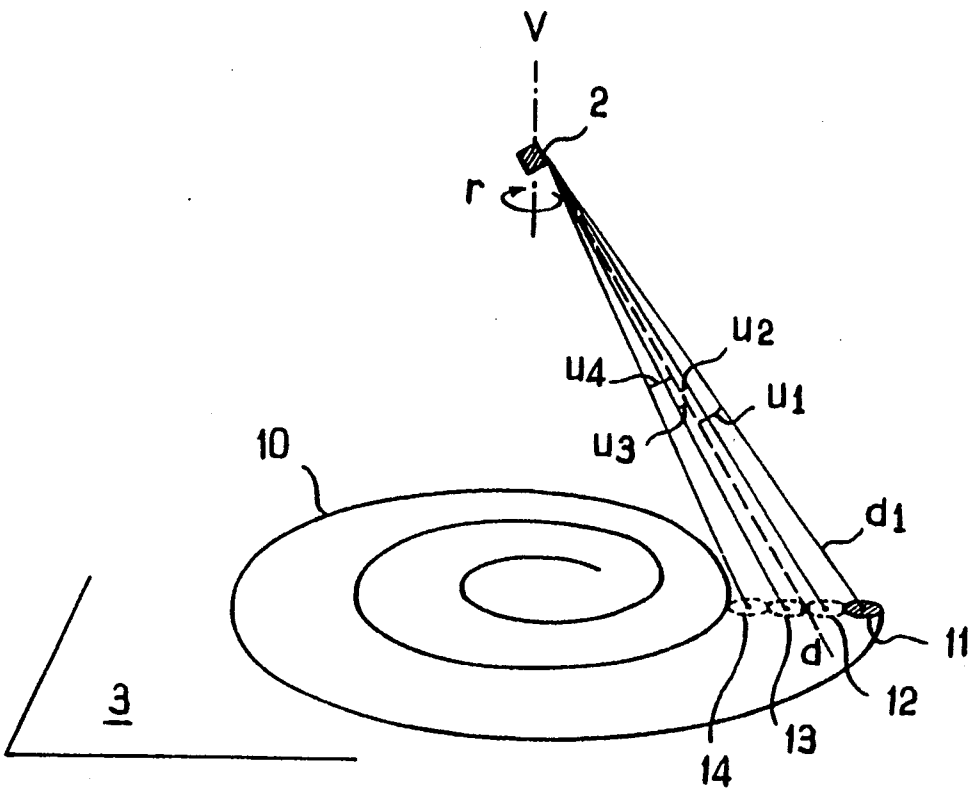
FIG. 8 is a schematic view similar to FIG. 1, but for the case of a submunition conforming to the invention according to the variant embodiment of FIG. 6.
Figure 10:
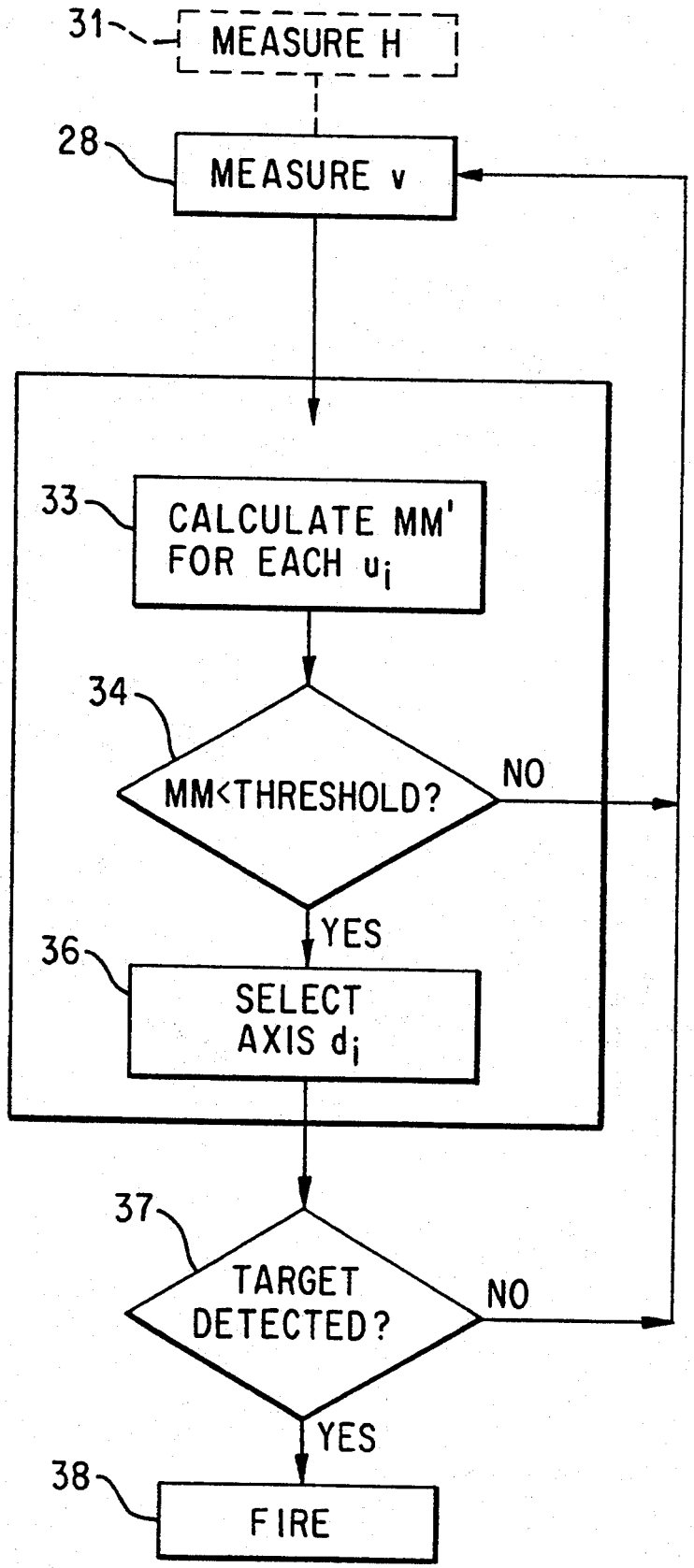
Figure 11:
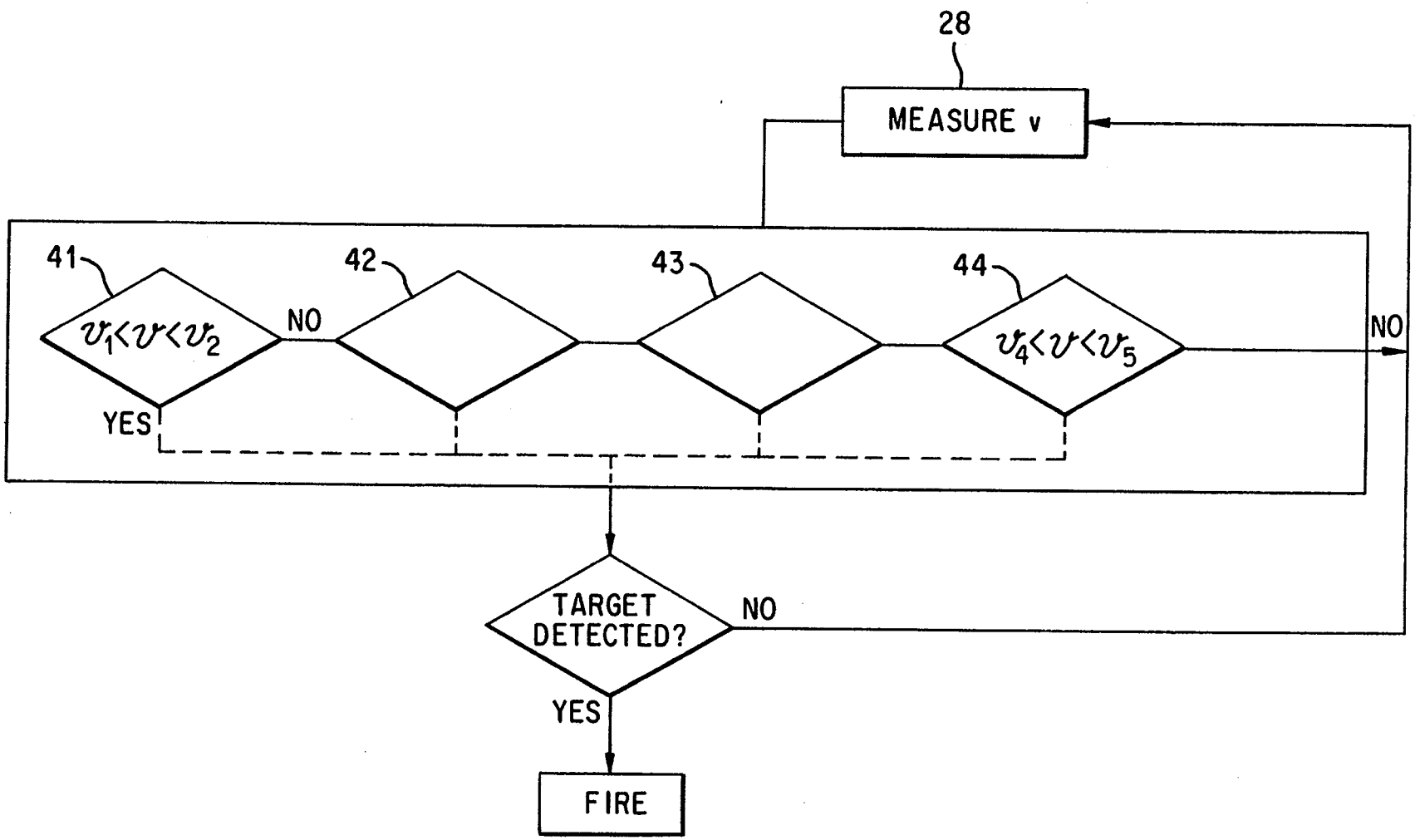

FIG. 7 depicts a variant of the device in FIG. 6 in which detectors 21 to 24 are distributed in a substantially symmetrical manner with respect to axis D of the shaped charge. In this embodiment, one optical system 26 is required for each pair of detectors 21, 22 and 23, 24. Of course, the distances of the two optical systems 26 from axis D must be adjusted so that the basic detection areas 11 to 14 are arranged correctly (FIG. 8).

Figure 9:
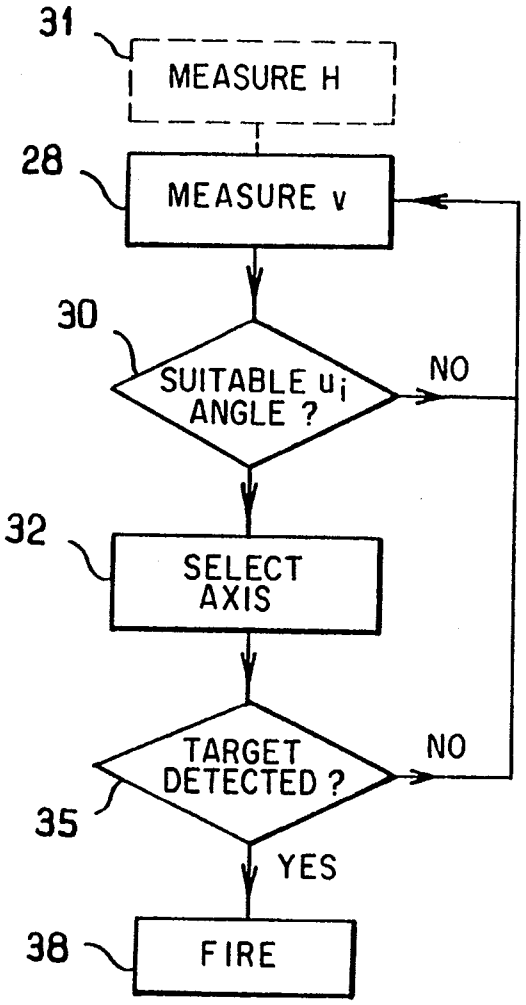
FIGS. 9 to 11 are diagrams giving examples of calculation flow charts that could be utilized in the devices according to the invention.

Calculation means 29 operates as follows (see FIGS. 9 to 11):

Velocity v is known at each moment, either indirectly based on a measurement of altitude above the ground (symbolized at 31) or directly via means 28 (see FIG. 9). For each value of v, the value of $u_i$ best suited for firing is determined by circuit 30. If there is no suitable value for $u_i$, firing is inhibited; otherwise, the corresponding axis $d_i$ is selected by circuit 32. If a target is detected by that axis, circuit 35 transmits the firing signal to circuit 38. Otherwise the process begins again with a recalculation of velocity v.

Selecting the value for $u_i$ best suited for firing can involve calculating the impact point deviation for each $u_i$ and utilizing the value that minimizes that deviation and is less than a threshold $u_s$. This operating mode corresponds to the diagram in FIG. 10.

Figure 3:
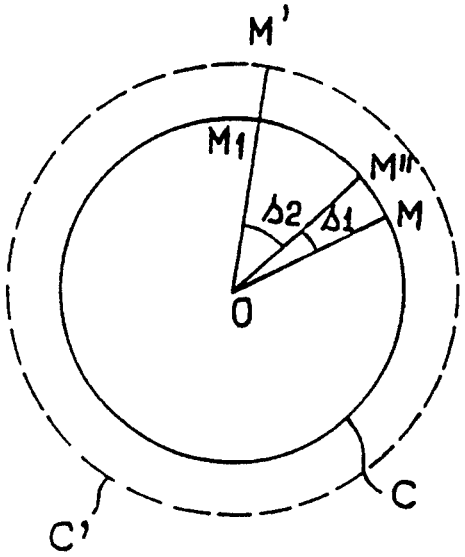
FIG. 3 PRIOR ART
FIG. 3 is a diagram schematically depicting the impact deviation associated with the delay between detection and ignition, and attributable solely to the rotation velocity of the shaped charge.
Figure 4:
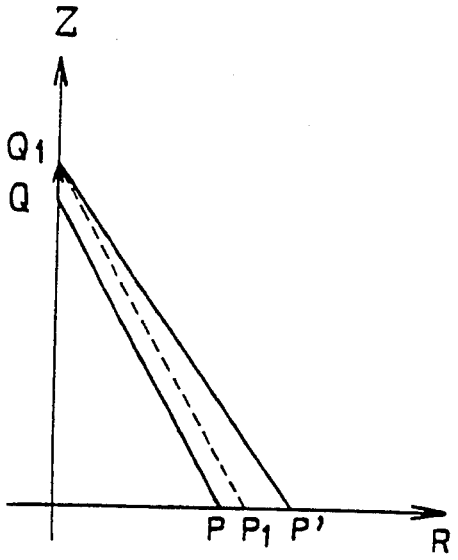
FIG. 4 PRIOR ART
FIGS. 4 and 5 depict schematically the impact deviation associated with the delay between detection and ignition, attributable to the vertical displacement velocity of the shaped charge, in ascending and descending trajectory, respectively.
Figure 5:
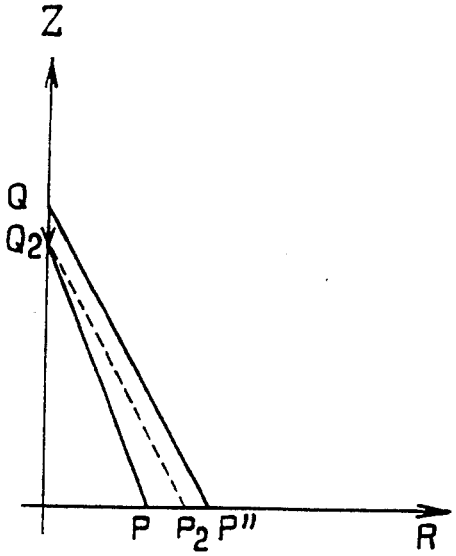
FIG. 5 PRIOR ART

At 33, the value of v is used to calculate the impact point deviation MM', or the total error attributable both to rotation and to vertical velocity (see FIGS. 3 and 8), for each value of angle $u_i$; at 34, the values of $u_i$ that yield a deviation less than the predetermined threshold $u_s$ are evaluated. If there is no suitable value, firing is inhibited; otherwise, the value $u_i$ that yields the minimum deviation is selected at 36, then the corresponding detection direction $d_i$ is activated at 37, and, if a target is detected, firing is triggered at 38. Otherwise, the procedure returns to the starting point at 28 with the determination of a new value for velocity v.

In another embodiment of the present invention, (see FIG. 11) several velocity ranges are defined, for example four ranges delimited by $v_1$, $v_2$, $v_3$, $v_4$, $v_5$, with which specific detection axes $d_1$, $d_2$, $d_3$, $d_4$, respectively, are associated. Means 28 provides at each moment an estimated value for velocity v. Thus, when v is between $v_1$ and $v_2$ (first velocity range), circuit 41 selects the detector for direction $d_1$. If v is not within the first velocity range, control passes to circuit 42, and, if necessary to circuits 43 and then 44, the latter corresponding to the fourth velocity range ($v_4<v<v_5$). When one of the velocity ranges is appropriate, the corresponding detection axis is selected. Under these conditions, if circuit 37 detects the target, firing is triggered by circuit 38; otherwise, the procedure restarts with a new velocity determination.

Of course, the invention is not limited to the embodiments just described, and numerous modifications can be made, without leaving the context of the invention.

For example, the number of detection means or detection axes is not meant to be limiting; the higher the number, the better the correction.

Since the detection means is not used simultaneously, a single sensor could be used but with a plurality of associated optical systems capable of producing different detection axes. In this case, the velocity measurement means, for example an accelerometer, could cause stepwise displacement of a shutter that allows only the beam coming from a specific optical system to pass. The advantage of this solution is that it includes only a single sensor, hence saving space and reducing costs.

It is also possible to define a submunition that is ejected vertically by a platform placed on the ground, in which the detection means can be oriented in two directions.

One direction would correspond to a particular minimization of the aiming error for the ascent phase of the submunition, and the other direction would correspond to minimization for the descent phase.

It would be sufficient to use two detectors having appropriate orientations, the choice of one detector or the other being made by calculation means 28 on the basis of "maximum altitude" information (i.e. corresponding to the transition between ascent phase and descent phase). This information could be supplied by an accelerometer (possibly coupled to an integrator). It could also be provided by an altimeter followed by a differentiator.

Lastly, it is possible to define a submunition ejected vertically from a platform or one dispersed above the terrain, in which the choice of a particular detection axis is made by calculation means 28 solely on the basis of the "altitude" data.

In that case, for example, four specific altitudes H1, H2, H3, H4 would be associated with detection axes d1, d2, d3, d4 respectively.

What is claimed is:

1. A directed-effect submunition projectable, before being detonated, along a substantially vertical axis above a region containing a target, said submunition having a displacement velocity along said vertical axis and a rotation velocity relative to said vertical axis, said submunition comprising:

a charge having an axis of symmetry forming a first angle with said vertical axis;

a detection device having a detection axis forming a second angle with said axis of symmetry;

means for detecting a target;

means for triggering said charge when said target is detected;

means for determining at least one of displacement velocity and altitude of the submunition with respect to the region containing said target;

calculation means for calculating, based on at least one of said displacement velocity and said altitude, a trajectory angle selected from among a set of trajectory angles, said trajectory angle minimizing a deviation existing between a position of a target instantaneously detected and an impact point of the submunition if the submunition were triggered upon detection of the target; and means for imparting said trajectory angle between said detection axis and said axis of symmetry.

2. A submunition according to claim 1, wherein the detection device is of an infrared type.

3. A submunition according to claim 1, wherein the detection device is of a millimeter-wave type.

4. A submunition according to claim 1, wherein the calculation means comprises means for comparing a minimum value of said deviation obtained for said trajectory angle to a threshold value, and means for inhibiting triggering of said charge upon detection of said target if said minimum value is greater than said threshold value.

5. A submunition according to claim 4, further comprising at least two detection units oriented along different respective angles with respect to said axis of symmetry, and means for individually activating the detection device forming said trajectory angle.

6. A submunition according to claim 4, wherein the submunition is launchable from the ground along a substantially vertical upward axis before descending substantially vertically, the submunition further comprising at least two detection units with orientations adapted respectively for an ascent phase and a descent phase, as well as means for recognizing the transition between the ascent and descent phase and for activating an appropriate detection unit of the at least two detection units in each phase.

7. A submunition according to claim 1, further comprising at least two detection units oriented along different respective angles with respect to said axis of symmetry, and means for individually activating the detection device forming said trajectory angle.

8. A submunition according to claim 7, wherein the at least two detection units each comprise a sensor, the sensors being coupled with a single optical system and defining detection axes with different orientations, wherein said sensors are individually activatable.

9. A submunition according to claim 7, wherein the at least two detection units comprise a single sensor coupled with an optical system of a group of optical systems and defining detection axes with different orientations, the optical systems being utilized independently.

10. A submunition according to claim 1, wherein the submunition is launchable from the ground along a substantially vertical upward axis before descending substantially vertically, the submunition further comprising at least two detection units with orientations adapted respectively for an ascent phase and a descent phase, as well as means for recognizing the transition between the ascent and descent phase and for activating an appropriate detection unit of the at least two detection units in each phase.

11. A submunition according to claim 10, wherein the means for recognizing said transition comprises an accelerometer.

12. A submunition according to claim 10, wherein the means for recognizing said transition comprises an altimeter.

13. A directed-effect submunition projectable, before being detonated, along a substantially vertical axis above a region containing a target, said submunition having a displacement velocity along said vertical axis and a rotation velocity relative to said vertical axis, said submunition comprising:

a charge having an axis of symmetry forming a first angle with said vertical axis;

a detection device having a detection axis forming a second angle with said axis of symmetry;

a target detector for detecting a target;

a trigger, triggering said charge upon detection of said target;

a position determinator for determining at least one of displacement velocity and altitude of the submunition with respect to the region containing said target; and a data processor for calculating, based on at least one of said displacement velocity and said altitude, a trajectory angle selected from among a set of trajectory angles, said trajectory angle minimizing a deviation existing between a position of a target instantaneously detected and an impact point of the submunition if the submunition were triggered upon detection of the target, said data processor imparting said trajectory angle between said detection axis and said axis of symmetry.

* * * * *